US005773802A

United States Patent [19]

Graves

[11] Patent Number: 5,773,802

[45] Date of Patent: Jun. 30, 1998

[54] HAIR CARE SYSTEM USING MICROWAVE ENERGY FOR HEATING

[76] Inventor: Carol Anne Graves, 3400 Tilden St., Brentwood, Md. 20722

[21] Appl. No.: 469,698

[22] Filed: Jun. 6, 1995

[51] Int. Cl.[6] ..... H05B 6/80

[52] U.S. Cl. ..... 219/759; 219/679; 219/222; 132/229; 132/233

[58] Field of Search ..... 219/759, 679, 219/687, 730, 222, 211; 132/229, 233, 234, 211, 222

[56] References Cited

U.S. PATENT DOCUMENTS

| | | | |
|---|---|---|---|
| 3,863,653 | 2/1975 | Boudouris et al. | 132/33 |
| 4,061,898 | 12/1977 | Murray et al. | 219/211 |
| 4,147,921 | 4/1979 | Walter et al. | 219/211 |
| 4,301,601 | 11/1981 | Carr | 132/9 |
| 4,459,471 | 7/1984 | Hulett et al. | 219/211 |
| 4,538,630 | 9/1985 | Henderson | 132/229 |
| 4,710,609 | 12/1987 | Switlicki | 219/759 |
| 4,849,593 | 7/1989 | Hughes et al. | 219/759 |
| 4,914,717 | 4/1990 | Gibbon | 219/759 |
| 5,030,820 | 7/1991 | Gibbon | 219/759 |

*Primary Examiner*—Philip H. Leung
*Attorney, Agent, or Firm*—Paul M. Craig, Jr.

[57] ABSTRACT

A hair care system for applying heat generated by microwave energy to hair, in which an auxiliary heat source is adapted to be exposed to microwave energy and convert the microwave energy into heat and store the same for subsequent use in treating or conditioning hair; the auxiliary heat source is a multi-layer structure and includes an outer layer substantially microwave-safe and remaining cool to touch, an insulation layer inside of the outer layer and also substantially microwave-safe, a further layer inside the insulation layer which converts microwave energy into heat, whereby the further layer is either of double-walled construction containing lossy dielectric material or a single layer of flexible material, or molded into a shape corresponding to the shape of a rigid outer layer, or includes a moisture-absorbing material adjoined on the inside by a layer of a moisture-proof material or a moisture-non-absorbing material having a close wave.

55 Claims, 5 Drawing Sheets

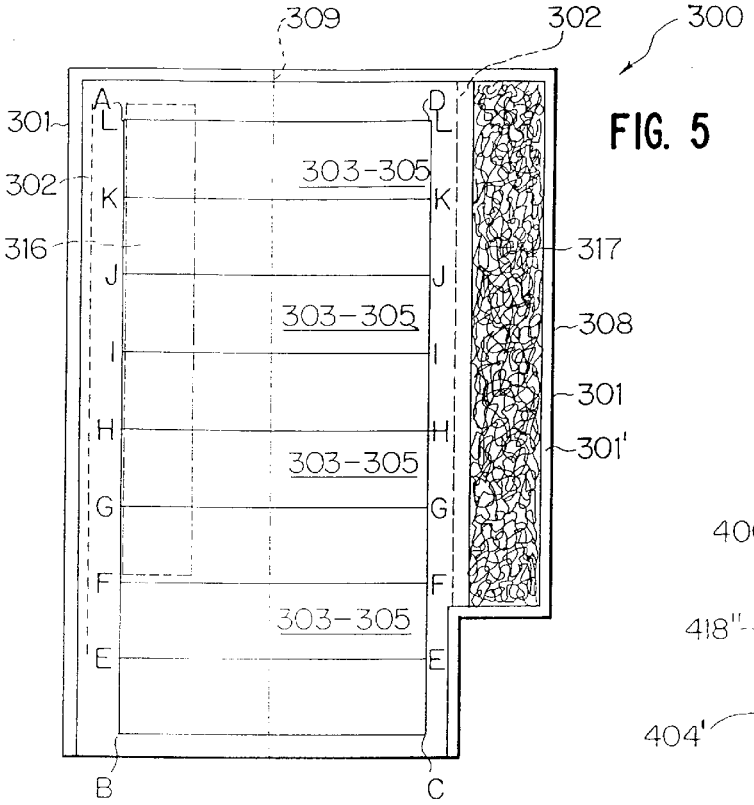
FIG. 5
FIG. 7
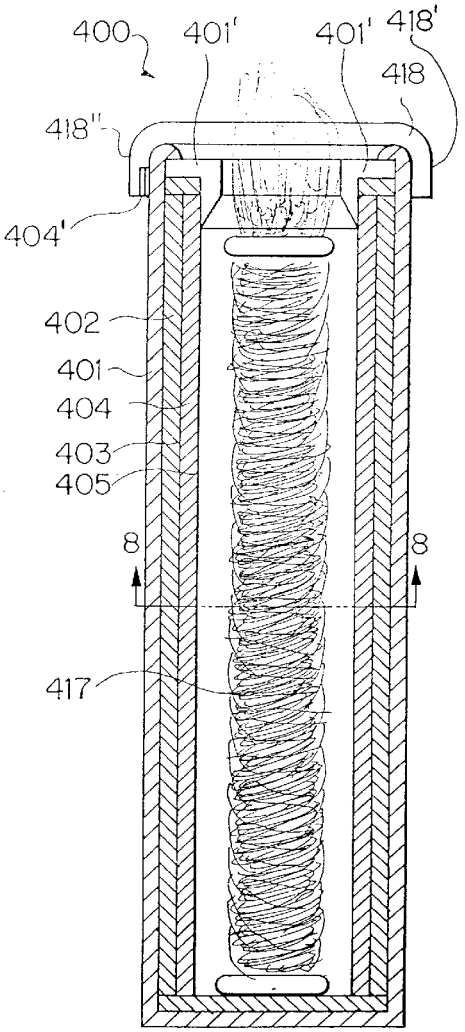
FIG. 9
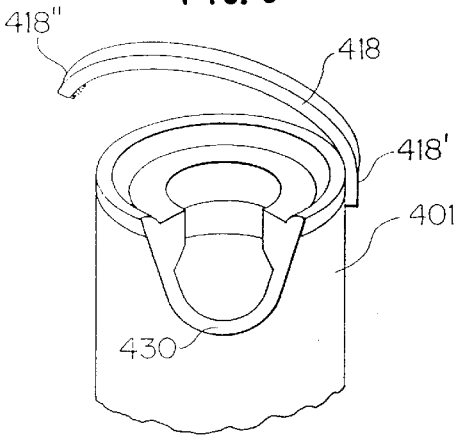

HAIR CARE SYSTEM USING MICROWAVE ENERGY FOR HEATING

FIELD OF THE INVENTION

The present invention relates to a hair care system for applying heat generated by microwave energy to hair in which a multi-layer structure forming an auxiliary heat source is adapted to be subjected to microwave energy to convert the same into heat and for locally applying the heat to hair in the form of a heat cap, heat wrap or heat tube.

BACKGROUND OF THE INVENTION

In the past, numerous ways of curling hair by heat applications have been used, such as with the use of curling irons, heat rollers, crimpers, etc. However, most of these prior art methods are time consuming. Additionally, some of the prior art methods require the user to be located at the same location for a long period of time for the particular used curling method. Moreover, some of these prior art heat-curling methods only heat the hair from the core area of the curl as is the case with the use of heat rollers and curling irons. Furthermore, these prior art methods do not usually permit enough heat to be radiated through the rolled hair to the outer layers thereof on the curler or curling iron rod to form a satisfactory wave.

Hair dryers, especially commercial hair dryers used in beauty salons are also known in the prior art which are normally electrically heated. However, the length of time required to sit under such hair dryers is relatively long and confine the person to remain at the location where such hair dryers can be used.

The use of caps for various hair treatments are also known in the art, such as for hair streaking (U.S. Pat. Nos. 4,267,850 and 4,724,852), for streak coloring hair (U.S. Pat. No. 3,302,653), for the protection of curls (U.S. Pat. No. 2,725,885) and for dyeing hair (U.S. Pat. No. 4,289,150). Furthermore, electrically heated tubes are known in the prior art for waving hair (U.S. Pat. Nos. 1,592,150 and 1,691,589). However, none of these prior art devices contemplate or disclose devices specifically designed for use with microwave energy.

The use of microwave energy to generate heat for treating or conditioning hair is also known in the prior art (U.S. Pat. Nos. 4,538,630; 4,710,609 and 5,030,820). They generally require hair curlers designed specifically for microwave heating (U.S. Pat. Nos. 4,538,630 and 4,710,609) which are microwave energy safe, thereby limiting the user to special kinds of curlers.

SUMMARY OF THE INVENTION

The present invention has as its principal object to avoid the aforementioned shortcomings and drawbacks encountered in the prior art and to provide a simple auxiliary heat source adapted to be heated by microwave energy, for example, in a microwave oven, whereby the auxiliary heat source can be easily manufactured in an economic manner, is simple and safe in handling and offers great versatility in its use with practically any type of curler, clip, rod, etc., which may be made of plastic material, metallic material, ceramic material, wood, etc. or a mixture thereof because the curlers, clips, rods, etc. do not need to be placed into a microwave oven. Instead, the auxiliary heat source of the hair care system of this invention is in the form of a multi-layer structure such as heat cap, heat wrap or heat tube which is placed into a microwave oven for a short period of time and is then used to apply heat to the hair, for example, to wound or rolled hair on a hair curler for an amount of time of, for example, one to five minutes, depending upon the length of the user's hair, the size of the lock of the wound hair and on the property of the hair, i.e., whether fine or coarse.

With the use of the heat cap according to this invention, heat is applied to the hair from an area external of the hair rolled on a roller. If the roller is of the open type, i.e., is open at both ends, then heat can also enter the inside core area of the roller-type hair curler which allows a very quick and efficient heat curling of the hair. The heat cap can also be used to assist in giving "hot oil" or "conditioning" treatments and the like to the hair. Furthermore, the heat cap can be used for applying hair coloring to the hair so as to enhance the process by saving time and to assist the hair color, especially in the use of the temporary hair color, to "take" efficiently. Additionally, the heat cap can be used for applying heat to the hair during the process of giving "heat-activated" permanents to bring about the chemical reaction required for such treatment.

If so desired, the present invention also provides a safety cap which could be placed over the user's head before the heat cap is installed.

Instead of a heat cap, the present invention also proposes auxiliary heat sources in the form of heat wraps or heat tubes which can be used in a similar manner on curlers or the like.

Common to the heat caps, heat wraps and heat tubes of this invention is the presence of a material capable of converting microwave energy into heat which is located inside of an outer layer of plastic material adjoined on the inside by a layer of insulating material. For dry hair treatment, this material consists of a lossy dielectric material enclosed in one or more pockets formed by a double-walled construction secured to the outer plastic layer and the insulating layer. Preferably, a number of such pockets are thereby formed in the double-walled structure by fastening, e.g., sewing them together in a quilt-like fashion.

For steam hair treatment, a moisture-absorbing material adapted to be sprayed with water is disposed inside of the insulation layer which is adjoined on the inside by a layer of fine-weave water-non-absorbing material.

A drawstring arrangement is used to secure the heat cap on the user's head whereby, for safety reasons, a safety cap may be first placed over the user's head which includes a protective brim extending over the area of the forehead, ears and neck area to shield it against heat from the heat cap and to guard the heat cap interior area from being soiled when oil or conditioning treatments, etc. are used, especially as the safety cap can be laundered.

The heat wraps are mounted over hair already mounted or rolled on curlers and are then closed by the use, for example, of Velcro fastening in overlapping areas of the wrap. In the case of heat tubes which are made from a more form-rigid material, the heat tubes are slipped over the curler or the like with hair being already present thereon. The heat wraps are frictionally held in place as the diametric dimensions can be varied by the amount of overlap. By contrast, the heat tubes are held in place by the use of a strap at the open end of the heat tube whereby one end of the strap is fixed on one side of the heat tube while the other end can be detachably secured to an approximately diametrically opposite area of the heat tube, preferably off-centered to permit the hair to exit the heat tube. The strap is preferably wide enough to be positioned over the main opening of the heat tube to retain or trap the heat while the heat tube is used during a heat tube treatment.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein:

FIG. 5 is a somewhat schematic elevational view of a heat wrap in accordance with the present invention as it appears in flat condition;

FIG. 7 is a somewhat schematic axial cross-sectional view through a heat tube in accordance with the present invention mounted over a curler with hair present;

FIG. 9 is a partial perspective view from the side of the heat tube of FIG. 7;

DETAILED DESCRIPTION OF THE DRAWINGS

Figure 1A:
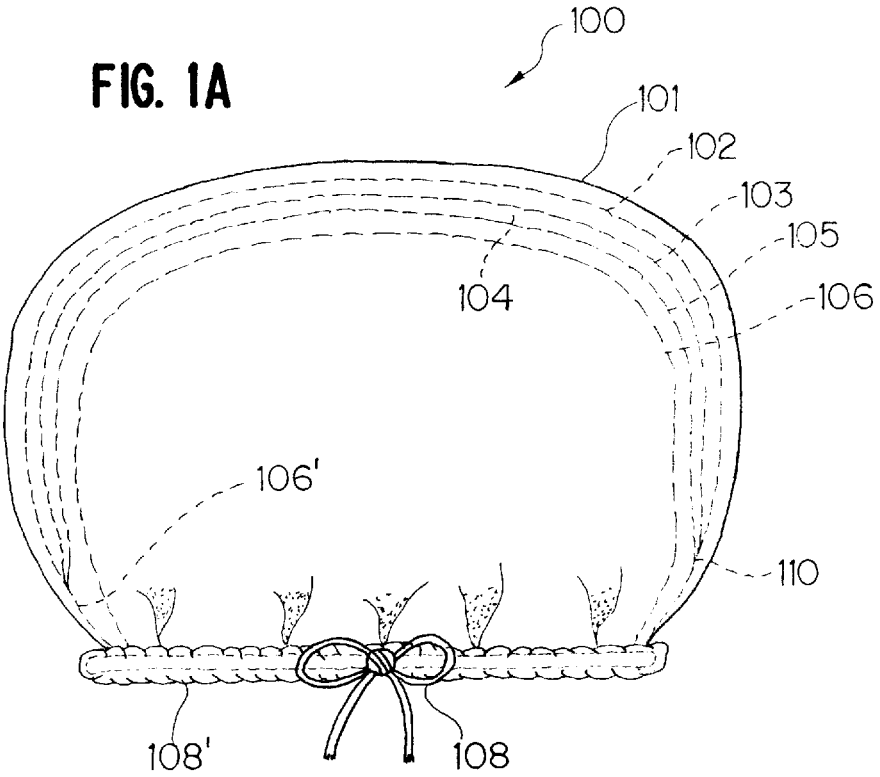
FIG. 1A is a somewhat schematic side elevational view of a heat cap in accordance with this invention which utilizes lossy dielectric material retained in pockets of a double-walled structure.
Figure 2:
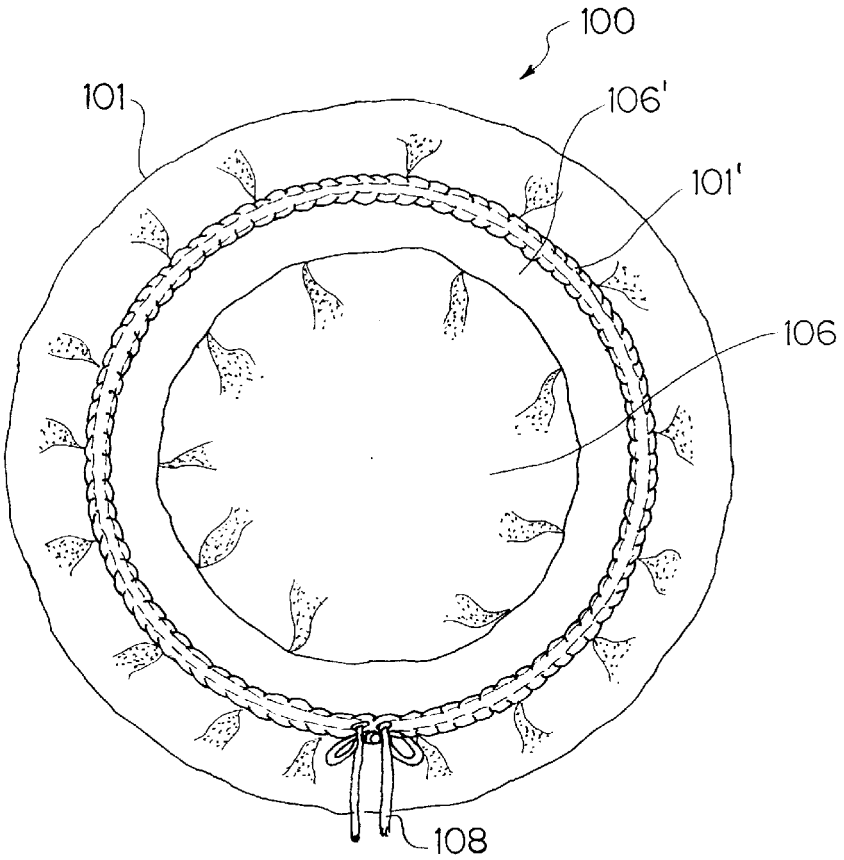
FIG. 2 is a somewhat schematic plan view on the heat cap of FIG. 1A in its inverted position.

Referring now to the drawing wherein like reference numerals are used throughout the various views to designate like parts, and more particularly to FIGS. 1A and 2, the heat cap generally designated by reference numeral 100 is intended for dry heat treatment to operate with lossy dielectric material permanently enclosed in a double-walled structure inside of the heat cap. The heat cap 100, which may be of shower-cap-like shape, includes an outer layer 101 which is microwave-safe. In the context of this application, the term "microwave-safe" refers to materials which are safe in the presence of microwave energy under normal operating conditions without likelihood of spontaneous combustion. The outer layer 101 is made of a flexible plastic material, for example, of a vinyl material of conventional commercially available type and appropriate thickness which stays cool to the touch and can be easily wiped clean in case of need. The outer layer 101 can also be chosen with decorative designs or patterns to enhance the appearance of the heat cap. Furthermore, the outer layer 101 may also be of dome-shape, which may then be made of a more rigid plastic of any known suitable type, whereby a drawstring arrangement could be attached around the bottom, which is then made of a short section of soft vinyl material fastened to the more rigid vinyl material at the lower end. On the inside of the flexible outer layer 101 is an inside layer 102 of a conventional flexible insulating material which does not collapse or flatten out in proximity of heat. For example, conventional commercially available plastic foam materials may be used for the insulating layer 102.

Inside of the insulation layer 102 is a double-walled structure 103, 105 enclosing therebetween lossy dielectric material 104. As the area of the drawstring arrangement should not be bulky, it is preferable to have an insulation layer 102 with a smaller diametric dimension than the layers 101, 103, 105 to minimize the number of layers within the drawstring area. The double-walled structure may consist of two layers of a microwave-safe material, such as nylon or nylon knit material, for example as used for strong nylon sock material, which can be readily sewn together. Different materials which are microwave-safe may also be used for the two walls 103, 105. The lossy dielectric material 104 is preferably of particulate or granular nature to preserve flexibility of the double-walled structure 103,105. To maintain a more or less uniform distribution of the lossy dielectric material 104 throughout the double-walled structure 103, 105, the latter preferably has a quilt-type configuration so as to form a number of enclosed pockets. Such a quilt pattern can be readily obtained as follows. The two layers 103 and 105 of, for example, cotton cloth are cut out in circular shape and are sewn together about a circle leaving open slightly less than one-half of the circle. Then two or more rows realized by stitching from inside the end area to the open end of the circle are next sewn to thus form a row of long tubes that are all open at only one end, i.e., within the area of the circle which had not been closed up. Then a predetermined amount of lossy dielectric material is put into the bottom of each tube whereupon each row is sewn cross-wise to form individual pockets containing the lossy dielectric material. These steps are then repeated to form a number of cross-stitched pockets until the entire circular area is sewn into small closed pockets containing the lossy dielectric material which causes the outer circumference to be completed in a circular shape. In one test, uncooked brown rice proved successful as lossy dielectric material though any other lossy dielectric material known in the art can be used which can be made to preserve the heat cap's flexibility. In case of more or less solid lossy dielectric material, it is only necessary to cut the same into sufficiently small pieces which are filled into a pocket in order to preserve the cap's flexibility. The need for pockets can be eliminated by the use of flexible sheet-like lossy dielectric material of known type which can be simply inserted into the double-walled structure 103, 105. It may also be possible in some cases to insert an appropriate flexible sheet-like lossy dielectric material directly between the insulating layer and a protective layer having appropriate characteristics.

The double-walled structure 103, 105 thereby terminates about one to about two inches short of the end of the circumference of the outer layer 101 and of the coextensive insulation layer 102 to leave a relatively cool circumferential area which is safe for the user's fingers to grip when placing the heat cap over the user's head to protect against burning of the fingers. As an optional safety feature in addition to the safety cap or if the safety cap is chosen not to be used, a still further layer 106 may be temporarily mounted over the double-walled structure 103, 105, for example, by the use of "Velcro" (a readily disengageable fastening means), which is coextensive with the circle of the outer layer 101 and insulation layer 102 to provide a safety layer on the inside of the heat cap that is easily removable and protects the areas 103, 104, 105 from being soiled if the safety cap is not used. Any appropriate plastic or porous washable material which remains relatively cool to the touch can be used for the layer 106. Layer 106 thus protects the areas 103, 104, 105 from getting soiled in case of repeated applications to the hair, and especially when the heat cap is used for hot oil treatments, or perms or conditioners to keep the chemicals off the material 105. For that purpose, a vinyl layer 106 would be most suitable.

The thickness of the various materials is not critical as long as they maintain the desired flexibility for the heat cap and are sufficiently light-weight to be comfortable to the head.

In the alternative, the layers 103, 105 can also be cut to the same size or of a slightly larger diameter than layers 101, 102 to allow for give when the pockets are filled with lossy dielectric material. The partial circle is then sewn approximately two inches inside of the outer edges of layers 103, 105 and the sewn pockets are filled with lossy dielectric material. The circle is then completed by sewing which provided a two-layer outer edge of about one to two inches consisting of layers 103, 105 without lossy dielectric material in between these two layers within the area. The entire outside edges of layers 101, 102, 103 and 105 are then sewed together at the same time whereupon the tubing strip 108' is sewed on with the drawstring 108 enclosed in the tubing strip 108'. This makes the outer edges 103, 105 part of the cool-to-touch area 106' (FIG. 2) and also automatically provides a double-layered protective covering over the insulation to prevent it from being snagged or torn.

In addition to the cool area 106' obtained by any of the methods described herein, handles, flaps or a protruding rim of plastic material such as vinyl, nylon, etc. could be sewn or otherwise fastened to the outer surface 101 in the area just above the drawstring area 108' to permit the user to hold onto the heat cap when putting it on so that fingers don't have to go into the heat cap near the area where heat exists.

To fasten the heat cap on the user's head, a drawstring arrangement is used which consists of a tubular member 108' formed from plastic material folded over to form a channel for the drawstring 108 and sewn together with the multilayer heat cap structure at the folded-over ends. However, any other known type of fastening arrangement, that is, microwave-energy-safe, such as an elastic band may be used with the heat cap.

As mentioned before, the parts 101 and 102 are cut out of at least approximately circular shape and may be fastened together along their edge areas in any conventional way, for example, by sewing, adhesive bonding, welding, etc. as long as the materials used are microwave-energy-safe. The parts 103 and 105 are cut out also of at least approximately circular shape with their radial dimensions the same as or slightly larger than layers 101 and 102 to allow for give when the lossy dielectric material is added, and then all layers 101–105 are sewn together at the same time at a radial dimension smaller by about one to about two inches from the open end to leave a cooler rim area which is not in contact with the heated parts 103, 105. The two parts 103 and 105 may be fastened along their edge areas in any conventional manner, for example, by sewing, adhesive bonding, welding, etc. However, the parts 101, 102, 103 and 105 may also be fastened together permanently by any conventional means, for example, by being sewn together simultaneously in the area 110, possibly at the same time as the fastening of a further protective layer 106 made of appropriate plastic material and arranged inside of the double-walled structure 103, 105, whereby the protective layer 106 is preferably of the same diametric dimension as the layers 101 and 102; this provides a safety rim 106' which is not in direct contact with the heated double-walled structure 103, 105. The outer layer 101 may also have the largest diameter with all other layers joined to it approximately one inch inside of its outer edge. The safety rim would then be constituted only by the outer layer 101 with only the drawstring tubing 108' sewn to the edge of the outer layer 101.

Figure 1B:
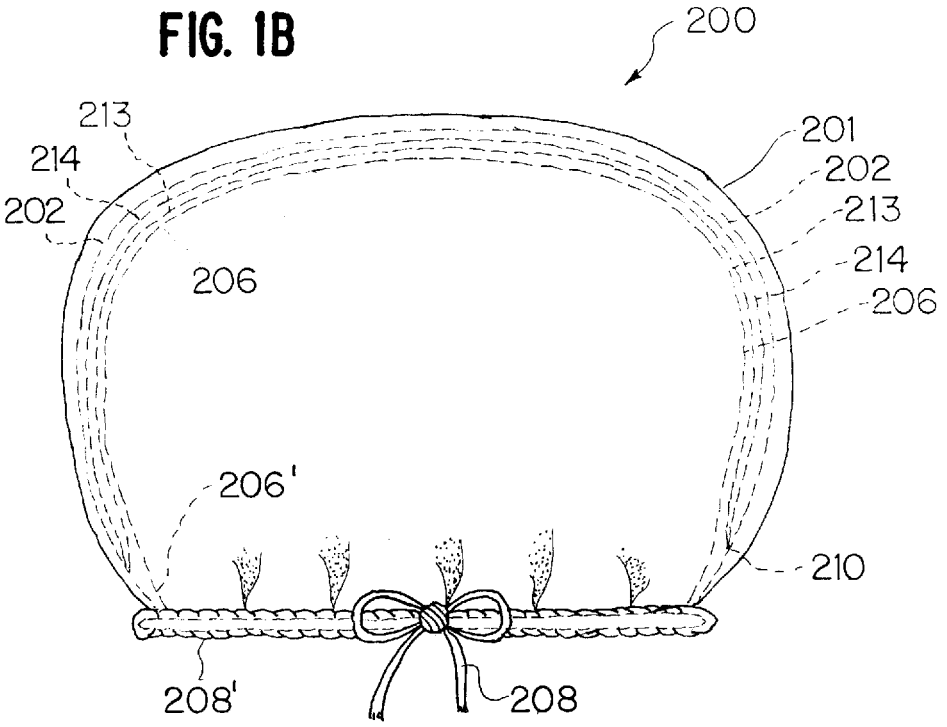
FIG. 1B is a somewhat schematic side elevational view, similar to FIG. 1A, of a modified embodiment of a heat cap of this invention utilizing moisture applied to a moisture-absorbing material as the lossy dielectric material.

In the embodiment of FIG. 1B, in which similar reference numerals of the 200 series are used to designate similar parts of those of FIG. 1A, the heat cap generally designated by reference numeral 200 again includes an outer layer 201 of flexible plastic material, for example, of flexible vinyl material adjoined on the inside by a flexible insulation layer 202. However, in lieu of a double-walled structure enclosing lossy dielectric material, the heat cap of this embodiment relies on a moisture-absorbing layer 213 which can be sprayed with a predetermined amount of water to produce heat and steam when subjected to microwave energy. A suitable moisture-absorbent material is, for example, a cotton terry cloth though other similar materials can be used in the embodiment of FIG. 1B. To protect the insulating layer from moisture and steam, a waterproof or moisture-proof layer 214 may be inserted between the moisture-absorbing layer 213 and the insulation layer 202. The waterproof layer 214 may be of any appropriate plastic material, known as such in the art, such as vinyl. The water-absorbent material 213 thereby terminates about one to two inches, preferably about one and one-half inches, short of reaching the diametric dimensions of the first two layers 201 and 202 of the heat cap. However, an approximately two-inch wide outer circle of a vinyl material may also be sewn to the outer edge area of the water-absorbent material layer 213 to provide one continuous layer that can then be sewn all at once on the stack of layers at the outer edge near the drawstring area. A removable waterproof layer 206 can be provided on the inside of the water-absorbing layer 213 which extends the full or close to the diametric dimension of the outer layer 201 and of the insulation layer 202 to provide again a safety rim 206' for the user's finger. With the use of a waterproof layer 206, no steam but only heat can reach the hair of the user or the safety cap 250 may be used. However, if steam setting is contemplated, the material for the layer 206 may be a fine-weave material, for example, a sheer nylon material, so as to permit a small amount of steam to penetrate therethrough or the heat cap may be ued without the layer 206. As to the rest, what was stated with respect to the embodiment of FIG. 1A applies equally to the embodiment of FIG. 1B and vice versa.

The various layers may be secured together in any suitable manner, for example, adhesively or by sewing them together. For example, the layers 102, 103, 104 and 105 and the layers 202, 213, 214 and possibly 206, if made of a woven or porous material, could be joined together near the area 110, 210 to the layer 101, 201. Then the tubing 108', 208' is joined to the outer edge of layer 101, 201. The layers 101, 102, 103, 104, 105 and possibly 106, if made of a woven or porous material, and the layers 201, 202, 213, 214 and possibly 206, if made of a woven or porous material, can also be sewn together at the same time within the area 110, 210 or the outer layers 101, 102 and 201, 202 can be sewn together and the layers 103, 105 and possibly 106, if made of a woven or porous material, as well as the layers 213, 214 and possibly 206, if made of a woven or porous material, can then be fastened together to the previously fastened, respectively, sewn together two outer layers and either be inserted loosely into the outer layers or also fastened thereto by any known technique. Furthermore, the shape of the heat cap may also be different from that of a typical shower cap, for example, may be more or less triangular with a flat apex.

In lieu of a flexible outer layer 101, 201, the outer layer 101, 201 may also be of a rigid plastic material such as a shape-retaining vinyl material with possibly more flexible vinyl rim around its open area which includes the drawstring arrangement. To assist the insulation and lossy dielectric material in holding and following the shape of the rigid plastic outer layer, such as, for example, a dome shape, rigid plastic stiffening members may also be provided in preselected areas in the interior of the heat cap between the outer layer and the insulation layer. Furthermore, a rigid plastic skeletal-like structure with a shape of the outer dome may be provided whereby the insulation layer and the lossy dielectric material is then arranged between the inner skeletal-like rigid plastic structure and the outer layer of rigid plastic material. The inner layer of rigid plastic material which may possibly be also of a grated design, then raises the lossy dielectric area above the hair and/or curlers and would allow warm air to quickly and freely circulate and would allow to keep the heated area clean. According to this last-described approach, the inside could be easily misted with water because the rigid shape would cause the opening to stay fully open and allow any left-over moisture to evaporate.

Figure 3:
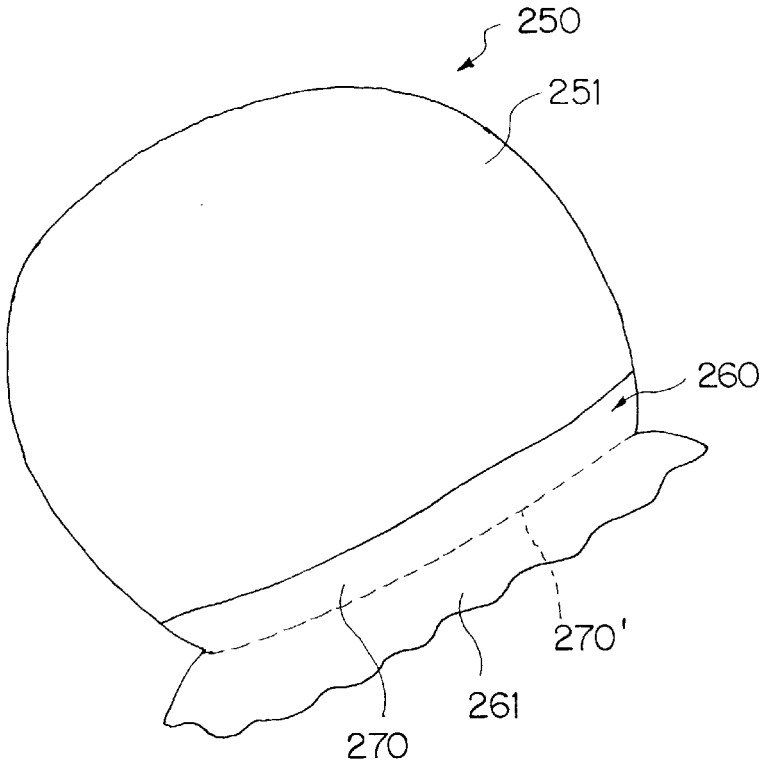
FIG. 3 is a somewhat schematic side elevational view of a safety cap in accordance with this invention.
Figure 4:
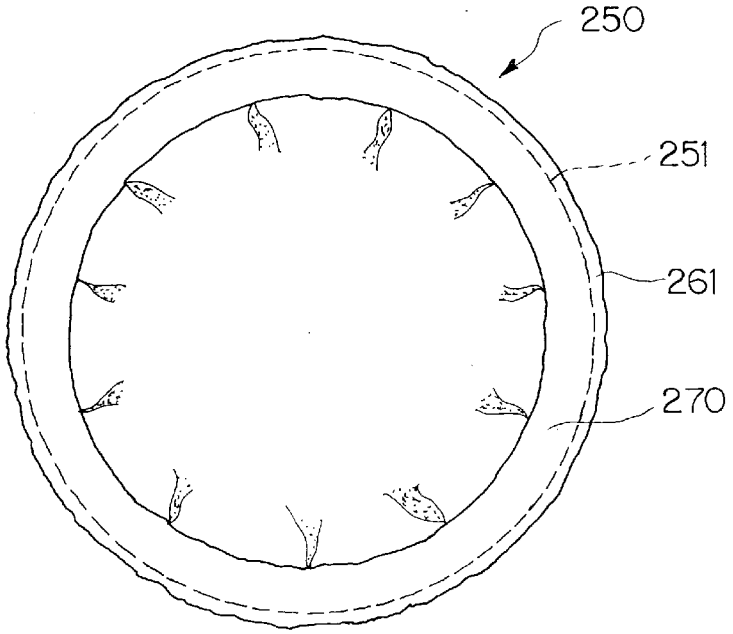
FIG. 4 is a somewhat schematic plan view on the safety cap of FIG. 3 in an inverted position.

The heat safety cap illustrated in FIGS. 3 and 4 and generally designated by reference numeral 250, which should be washable, can optionally be applied to the head of rolled or set hair to protect the forehead, ears and neck areas of the user against heat. The safety cap 250 includes an upper cap portion 251 made of sturdy nylon or other porous material and having an upper cap area 251 at least approximately corresponding with the heated area of the "heat cap" of FIG. 1A or 1B and of a corresponding design, for example, made from a circular cut. The cap portion 251 is joined at the edge of its circumference by a protective brim generally designated by reference numeral 260 which is preferably a double layer of a material comfortable to the touch such as cotton or vinyl material. The upper part 270 of the protective brim 260 extends from just above the hair line in the hair area to just below the hair area into the areas of the user's upper forehead, above the ears, and back areas of the neck, to form a circular band 270 to protect the user's forehead, ears and back areas of the neck, thus assuring that heat from the heat cap does not accidentally come into contact with any of these areas. The safety cap 250 may be fastened on the user's head at the area 270' of the brim 260, by a conventional drawstring arrangement but preferably utilizes an elastic band material 270' which is sewn on the inside within the area of or between the double layers of the protective brim 260, between the upper part 270 and the lower part 261, the elastic material being indicated at 270'. Instead of sewing, any other type of fastening such as adhesive bonding, welding, etc. could be used. The safety cap 250 could be made of several materials and also several combinations of materials. For example, the safety cap may be an all-vinyl cap, an all-cotton cap, an all-nylon cap, a nylon cap with a vinyl brim, etc. The upper cap portion 251 may also be made of a material "moisture proof" when applied to the hair for a hot oil or conditioning treatment or for heat-activated perms, etc., to prevent any chemicals from reaching the heat cap 100, 200 and becoming soiled and possibly losing its microwave safeness. The upper cap portion 251 can also be made of a water-absorbent material to be lightly misted with water on its outer surface as a source of steam when a hot heat cap 100, 200 is applied over it. This would provide more of a controlled amount of steam with cap 200 using a moisture-proof liner between the heat source in cap 200 and the safety cap. Furthermore, as mentioned, an all-vinyl safety cap should be used when oil treatments, heat perms or any other chemical or hair spray, etc. is on the hair to keep these chemicals from getting into or onto the exterior or interior of the heat cap.

Figure 6:
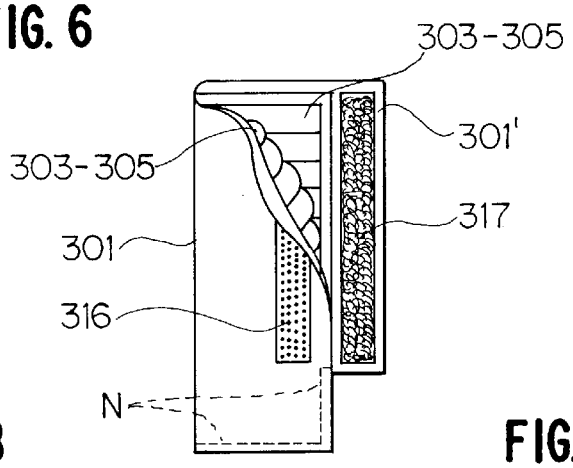
FIG. 6 is a somewhat schematic elevational view illustrating the heat wrap of FIG. 5 in folded condition before being fully closed.

FIGS. 5 and 6 illustrate a heat wrap which utilizes the same principle of construction as the heat cap of FIGS. 1A and 2, similar reference numerals of the 300 series being used to designate similar parts.

Differing from the embodiment of FIG. 1A, the outer layer 301 is provided with the rough side of a Velcro fastener strip 316 (FIG. 6) adapted to engage with the fuzzy side of the Velcro strip 317 provided on the inside of a flap forming an overlapping extension 301' provided at one end of the outer layer 301. The dash line N in FIG. 6 represents the line where the various parts may be sewn together in folded condition, whereby the line N extends across the bottom and up a predetermined distance equal to the height of the heat wrap less the height of the flap 301' so that the bottom of the heat wrap is closed and forms a partially closed tube for the lossy dielectric material. FIG. 5 thereby also shows how the individual pockets can be formed in that the double-walled structure is sewn up first along the line A-B from top to bottom, then the bottom is sewn together along line B-C, and then the double-walled structure is sewn up along line C-D, and possibly the fold line 309 is also formed. A number of vertical tubular pockets are then formed by sewing along a number of parallel lines E-L to form the vertical pockets which are then filled from the bottom up, whereby after filling of a predetermined amount of lossy dielectric material into each vertical pocket, a horizontal stitching line is formed along line E-E. These steps are then repeated until all stitching lines F-F, G-G, H-H, I-I, J-J, K-K and L-L are completed with each pocket filled with a predetermined amount of lossy dielectric material. The dash lines 302 are sewn while the heat wrap is still in an open flat position while line 309 indicates folding lines about which the heat wrap is folded before being sewn together at line N. Installed over a curler, such as a spiral type or other somewhat similarly shaped curler, or over a rod, the heat wrap 300 is held in place by the frictional engagement of the double-walled structure 303–305 which can be made to more or less tightly surround the curler or rod depending on the tightening of the heat wrap by means of the Velcro fastening arrangement 316, 317 In addition, a fresh traditional thin end paper or the like may be dipped in or sprayed with water and then wrapped around the hair on the curler just before the heat wrap is applied to the preferably dry hair wound on the curler to cause a steam setting and also to protect the inside of the heat wrap from any hair spray and the like that may be present on the preferably dry hair. The closed heat wraps may be stacked flat in a container such as in FIGS. 11 and 12 with the absence of the inner dividers 601*a* and one of the side walls 601 removed for easy access to the wraps but including a wall of insulation in the bottom 602" and insulation 602' inside of the outer wall and may be heated by microwave energy such as in a microwave oven for an adequate amount of time depending on the number of wraps present to be heated. The diameter and length of the curler or rod and the thickness and length of hair wound on it should be taken into consideration in the size of the heat wraps to be made and the length of time to allow the heated wraps to remain on the hair wound on the curler being an approximate time of not less than two minutes.

Figure 8:
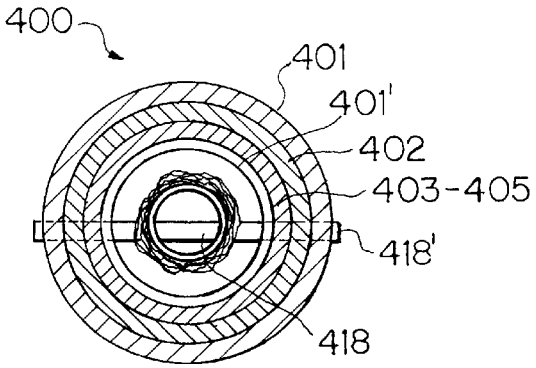
FIG. 8 is a somewhat schematic cross-sectional view, taken along line 8—8 of FIG. 7.
Figure 10:
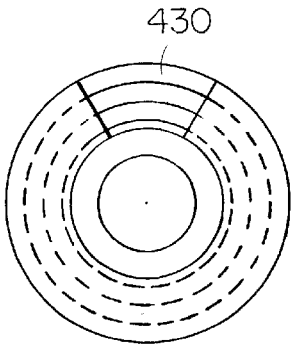
FIG. 10 is a top plan view on the heat tube of FIG. 7 with the locking strap removed.

FIGS. 7 through 10 illustrate a further embodiment of the present invention in the form of a heat tube in which similar reference numerals of the 400 series are used to designate similar parts of the embodiment of FIG. 1A. The heat tube generally designated by reference numeral 400, includes an outer layer 401 made of a more form-rigid plastic material such as Rubbermaid or Tupperware adjoined by an insulation layer 402 which in turn is adjoined by a structure containing the lossy dielectric material 404 which may again be a double-walled structure 403, 404 and 405 as in the embodiment of FIG. 1A. The heat tube, which is to be placed into a microwave appliance such as a microwave oven and is to be heated for a short period of time, is thereby slipped over, for example, a spiral curler 417 on which dry, preferably clean hair is wound and is held in place by a locking strap 418, whose one end 418' is fixed to the outer layer 401 and whose other end 418" is detachably secured, for example, by a Velcro fastener 404' to the approximately diametrically opposite side of the outer layer 401. However, as shown in FIG. 8, the locking strap 418 is preferably arranged off-center so as to facilitate exiting of the hair from the heat tube 400. The locking strap 418 is preferably sufficiently wide (not shown) to cover the main central opening so as to trap the heat while the hair exits out of the extended area of the central opening near the outer edge surface. Additionally, the multi-layer structure may also be provided with an approximately tear-shaped opening 430 to facilitate exiting of the hair. The construction as shown in FIG. 9 with its extended opening on the top of the side wall as also in FIG. 10, or on the outer edge of the top surface, allows the hair to be wound on a curler or rod with hair exiting the heat tube very close to the scalp to give a wave to nearly the entire length of the lock of hair.

Figure 11:
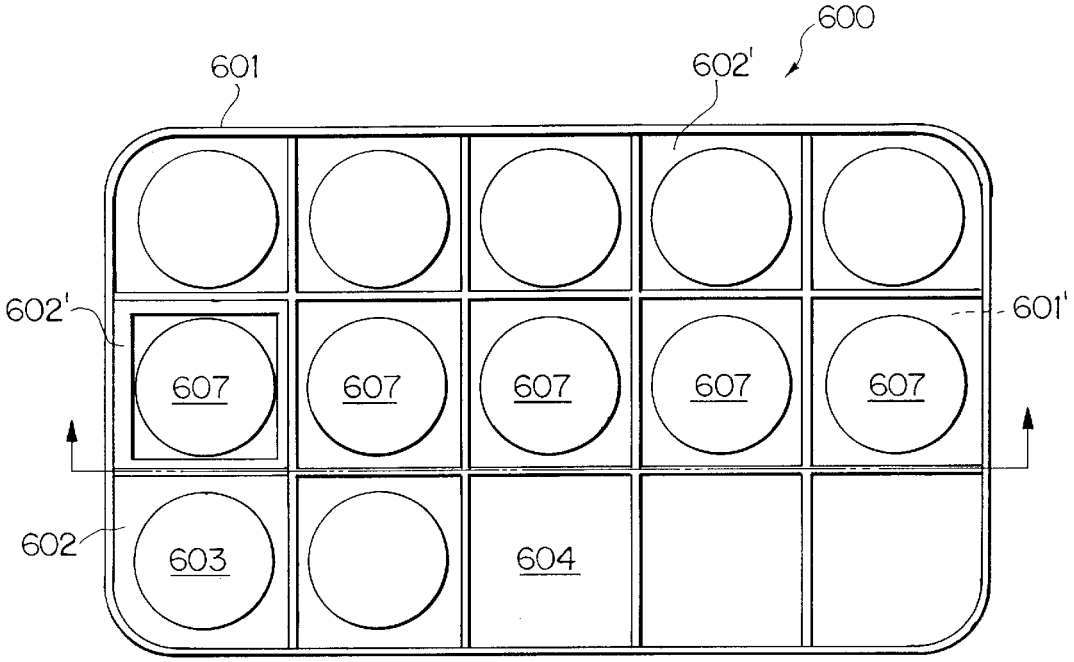
FIG. 11 is a somewhat schematic top plan view on a heat tube container in which the heat tubes are stored upside down so that the openings of the heat tubes are covered by the bottom of the container.
Figure 12:
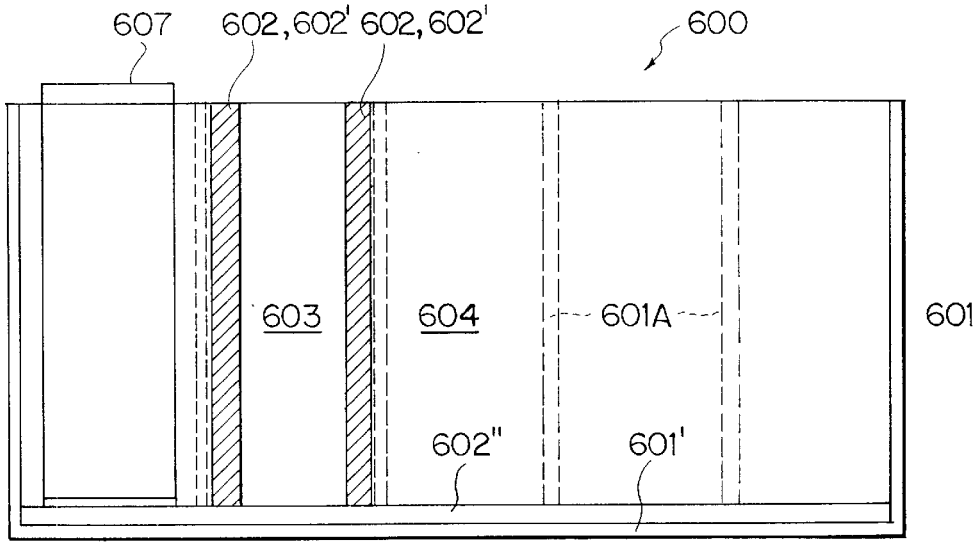
FIG. 12 is a somewhat schematic side elevational view of the heat tube container of FIG. 11, partly in cross section.

FIGS. 11 and 12 schematically illustrate a container for storing the heat tubes and possibly heat wraps in the microwave oven. The container generally designated by reference numeral 600 includes an outer wall 601 made of microwave-safe plastic material with the inner area of the container 600 subdivided into individual compartments 604 whereby some of the compartments include insulation material 602 conforming to the external configuration of a heat tube while other compartments may have a square insulating liner 602', to indicate for illustration purposes only the different arrangements which can be used. The container 600 includes a bottom 601' interconnecting the side walls 601. In FIG. 11, reference numeral 607 schematically indicates heat tubes or heat wraps whereby the compartment insulation is shaped accordingly. The bottom 601' includes a bottom insulation layer 602' while reference numeral 603 designates an open area within an insulation before a heat tube or heat wrap is installed. The compartments 604 in FIG. 11 are an open area without insulation, delimited only by rigid plastic side walls. Reference numeral 601A designates an inner wall forming a divider between separate compartments which can be made of the same material as the outer container walls 601. As shown in FIG. 12, the heat tubes 607 extend above their respective container compartment for easy removal of each tube. The heat tube is placed into its compartment upside down so that its opening faces the bottom insulation 602". With the heat tubes in this position, while heated by microwave energy, the heat can be adequately maintained in each heat tube until ready for each use thereof because heat rises; the closed bottom end of the tube is at the top, and there is no opening in that end of the heat tube for heat to escape. With the use of a heat cap, it is preferable that the heat cap have some kind of round container of a shape similar thereto in which to heat the cap because it would tend to keep the heat cap contained in such container and not allow its edges to touch the sides of the microwave appliance which may pose some problems. The container 600 is useful for storing a number of heat tubes in the microwave oven and keep them in proper position when being subjected to microwave energy. The heat tubes may be placed in an upright position in their container with their openings at the top surface of their container between uses and during storing to allow for evaporation of any moisture that may have remained within a heat tube after its use. The heat wraps could be stored in a container with the heat wraps folded and stacked flat, whereby an opening is provided in the front or preferably on the side extending the full length of the stacked heat wraps for easy removal. In most cases the containers may be provided with a vented, removable lid which may be used for safe transportation, etc.

While I have shown and described several embodiments in accordance with the present invention, it is understood that the same is not limited thereto but is susceptible of numerous changes and modifications as known to those skilled in the art; and I therefore do not wish to be limited to the details shown and described herein, but intend to cover all such changes and modifications as are encompassed by the scope of the appended claims.

I claim:

1. A hair care system for applying heat generated by microwave energy to hair, comprising an auxiliary heat source means adapted to be exposed to microwave energy and operable to convert the microwave energy into heat and store the same for subsequent use in curling, waving, treating or conditioning hair, said auxiliary heat source means, which can be exposed to a microwave energy source and then be removed from said microwave energy source to be used elsewhere in applying heat to hair, being a multi-layer structure having an outside and an inside and including, going in the direction from the outside toward the inside, first means forming an outer layer means remaining cool to touch, second means inside of said first means and forming an insulation layer means, third means forming a flexible layer means inside said insulation layer mans and operable to convert microwave energy into heat and store the heat, and fourth means for securing said multi-layer structure in place over a user's hair to enable application of heat about hair, said second means being operable to cause the application of heat externally of the hair located on the inside of said multi-layer structure in a direction toward the inside.

2. A hair care system according to claim 1, wherein said multi-layer structure is a heat cap adapted to be secured over the hair of a user, and wherein said first, second, third and fourth means are microwave-safe to avoid fire hazards.

3. A heat cap according to claim 2, wherein said third means is a double-walled structure forming pocket means to accommodate lossy dielectric material therebetween.

4. A heat cap according to claim 3, wherein said lossy dielectric material is of a type maintaining flexibility of said double-walled structure.

5. A heat cap according to claim 4, wherein said dielectric material is constituted by a large number of small pieces, and wherein said double-walled structure includes inner and outer layers fastened together in a quilt-like manner to accommodate the lossy dielectric material in the pockets formed thereby.

6. A heat cap according to claim 3, further comprising a removable washable layer removably joined to one of the third means or the cool outer area in a temporary manner to protect the interior of the heat cap from soiling, said washable layer being made from one of porous or non-porous vinyl or nylon material.

7. A heat cap according to claim 3, further comprising one of handle means, flap means or rim area means made from plastic material to facilitate gripping of the outer layer and prevent fingers from touching the inside of the heat cap.

8. A heat cap according to claim 2, wherein said third means includes a layer of moisture-absorbing material.

9. A heat cap according to claim 8, wherein said third means includes a layer means inside of the layer of moisture-absorbing material and forming a moisture-non-absorbing layer means.

10. A heat cap according to claim 9, wherein said third means includes a layer means of moisture-proof material between said layer of moisture-absorbing material and said insulation layer means.

11. A heat cap according to claim 9, wherein said moisture-non-absorbing layer means is made from a moisture-proof material to keep any moisture originating at the moisture-absorbing layer away from the hair.

12. A heat cap according to claim 9, wherein said moisture-non-absorbing layer means is made from a moisture-non-absorbing material with a close weave to allow a small amount of steam from said moisture-absorbing layer to penetrate through said moisture-non-absorbing layer means for steam-setting of rolled or set hair and/or hair conditioning treatment.

13. A heat cap according to claim 12, wherein said moisture-non-absorbing layer means is made from close-weave nylon material.

14. A heat cap according to claim 2, wherein said fourth means includes drawstring means for securing the heat cap on a user's head.

15. A heat cap according to claim 14, wherein said drawstring means includes a separate strip cut to appropriate length and after being folded over, being fastened to the first means to form a channel accommodating a drawstring.

16. A heat cap according to claim 2, wherein said first, second and third means are of at least approximately circular shape and are fastened together in circumferential areas.

17. A heat cap according to claim 16, wherein said third means terminates a predetermined distance from the edge of the second means to leave exposed a circumferential area of relatively cool insulation material which may be gripped by the user's finger during emplacement of the heat cap on a user's head.

18. A heat cap according to claim 16, wherein said first, second and third means are joined together.

19. A heat cap according to claim 18, wherein at least some of said first, second and third means are joined together by a readily disengageable fastening means.

20. A heat cap according to claim 18, wherein said first, second and third means are sewn together simultaneously.

21. A hair care system of claim 2, further comprising a safety cap forming an inner liner of the heat cap, the safety cap comprising a bonnet-like means made from a material that is substantially devoid of water-absorbing properties, a protective brim-like means extending from the free edge of the bonnet-like means, and additional means inside said brim-like means for holding the bonnet-like means in place on a user's head before the heat cap is mounted over the safety cap.

22. A hair care system according to claim 21, wherein said protective brim-like means is formed by a double layer of a material capable of protecting the areas of a user's forehead, ears and neck from the heat of the heat cap.

23. A hair care system according to claim 21, wherein said additional means is an elastic band secured inside of said brim-like means within the area near to the latter's connection to said bonnet-like means.

24. A hair care system according to claim 21, wherein said bonnet-like means is made from one of waterproof material and moisture-non-absorbing material.

25. A hair care system according to claim 21, wherein said bonnet-like means is made from one of waterproof material and moisture-absorbing material.

26. A hair care system according to claim 21, in which said safety cap includes any one of the following combinations:

a) a porous bonnet-like means made from nylon with a moisture-proof brim-like means made from vinyl, b) an all-vinyl bonnet-like means and brim-like means, c) an all-porous material bonnet-like means and brim-like means made from a material such as cotton, d) a plastic bonnet-like means and porous brim-like means.

27. A hair care system according to claim 2, wherein said first and second means are flexible.

28. A hair care system according to claim 2, wherein said first means is at least partially rigid.

29. A hair care system according to claim 28, wherein said heat cap is of at least approximately dome shape.

30. A hair care system according to claim 28, wherein most of said heat cap is of substantially rigid plastic material and includes a cap portion of flexible vinyl material attached to and extending from the free edge area of the rigid plastic material outer layer of the first means.

31. A hair care system according to claim 30, wherein said fourth means in the form of a drawstring arrangement is located within said flexible portion.

32. A hair care system according to claim 31, wherein said second means, said third means and said flexible portion are attached to the substantially rigid portion of said first means within the same area.

33. A hair care system according to claim 28, wherein the inner layer of the fourth means is substantially rigid taking on the shape of the rigid part of the at least partially rigid first means.

34. A hair care system according to claim 1, wherein said multi-layer structure is a heat wrap adapted to be mounted over a hair curler after hair is wound upon the curler, and wherein said first and second means are flexible.

35. A hair care system according to claim 34, wherein said third means includes lossy dielectric material.

36. A hair care system according to claim 35, wherein said lossy dielectric material is such that said third means remains flexible.

37. A hair care system according to claim 36, wherein said dielectric material is constituted by a large number of small pieces, and wherein third means include a double-walled structure whose inner and outer layers are fastened together in a quilt-like manner to accommodate the lossy dielectric material in pocket means formed thereby.

38. A hair care system according to claim 35, wherein said third means has a flexibly bulging configuration to hold the heat wrap on a curler by frictional engagement.

39. A hair care system according to claim 35, wherein said first part is made from flexible vinyl material, said second means is made from flexible insulation material and said third means is also flexible.

40. A hair care system according to claim 34, wherein said fourth means includes frictional fastening means between overlapping portions of said first and third means.

41. A hair care system according to claim 40, wherein said frictional fastening means includes a strip of rough Velcro material on the outside of said first means and a strip of fuzzy Velcro material on the inside of a flap forming an extension of said first means and adapted to overlap said first-mentioned strip in the installed condition of the heat wrap.

42. A hair care system according to claim 41, wherein said strips are substantially coextensive and extend at least over a part of the length of the heat wrap.

43. A hair care system according to claim 42, wherein said flap extends only over a part of the length of the heat wrap with the remaining part of the length and adjacent bottom secured together.

44. A hair care system according to claim 42, wherein said flap extends over the entire length of the heat wrap with the heat wrap open at the top and bottom.

45. A hair care system according to claim 1, wherein said multi-layer structure forms a heat tube adapted to be slipped over a hair curler after hair is wound upon the curler, wherein said first, second and third means form a tubular member, and wherein said first means is made from form-rigid material, said tubular member being open at one end and closed at the other end.

46. A hair care system according to claim 45, wherein said third means is a double-walled structure enclosing lossy dielectric material.

47. A hair care system according to claim 46, wherein said first, second and third means are provided with a tear-shaped opening on the top of the side wall of the heat tube to enable exiting of hair wound upon a curler.

48. A hair care system according to claim 46, further comprising strap means extending approximately diagonally over the open end and operable to hold the heat tube in place over a curler.

49. A hair care system according to claim 48, wherein said strap means is secured to the heat tube at one end and is adapted to be detachably secured to the heat tube at the other end and is of such width as to at least partially cover the open end.

50. A hair care system according to claim 48, wherein said strap means extends off center over the open end.

51. A hair care system according to claim 48, wherein said strap means extends over the center of the open end.

52. A hair care method of curling, waving, treating or conditioning hair by applying heat from a microwave energy source with the use of an auxiliary heat source to hair of a user's head, comprising the steps of briefly exposing the auxiliary heat source formed by a multi-layer structure in the form of one of heat cap, heat tube and heat wrap containing a flexible lossy dielectric material between the outside that remains cool to touch and provides an insulation to direct the heat inwardly onto the hair and an inside adapted to be secured over the hair, to microwave energy from said source of microwave energy in a first location away from the user's head to thereby heat the lossy dielectric material out of contact with the hair and therewith store heat in the multi-layer structure for subsequent use in curling, waving, treating or conditioning hair, removing the multi-layer structure, after being briefly heated by said microwave energy source, from said microwave energy source at said first location, and subsequently placing the thus removed multi-layer structure, now constituting the auxiliary heat source, over the user's hair to be heated by the heat stored in said multi-layer structure to thereby effect curling, waving, treating or conditioning of the hair.

53. A method according to claim 52, wherein the multi-layer structure in the form of a heat cap is placed over the hair area of the user's head to heat hair previously rolled or wound on an object such as curlers, rods or in clips, safe to the user's head to temporarily place the hair on it so as to cause the hair to take on the shape of the object.

54. A method according to claim 53, wherein a safety cap is applied over the user's head before the heat cap is placed over the safety cap.

55. A hair care system for applying heat generated by microwave energy to hair, comprising an auxiliary heat source means adapted to be exposed to microwave energy and operable to convert the microwave energy into heat and store the same for subsequent use in curling, waving, treating or conditioning hair, said auxiliary heat source means, which can be exposed to a microwave energy source and then be removed from said microwave energy source to be used elsewhere in applying heat to hair, being a multi-layer structure and including first means forming an outer layer means remaining cool to touch, second means inside of said first means and forming an insulation layer means, third means forming a flexible layer means inside said insulation layer mans and operable to convert microwave energy into heat and store the heat, and fourth means for securing said multi-layer structure in place to enable application of heat to hair, said multi-layer structure being a heat cap adapted to be secured over the hair of a user, further comprising a safety cap forming an inner lining of the heat cap, the safety cap comprising bonnet-like means made from a material that is substantially devoid of water-absorbing properties, a protective brim-like means extending from the free end of the bonnet-like means, and additional means inside said brim-like means for holding the bonnet-like means in place on a user's head before the heat cap is mounted over the safety cap.

* * * * *